US005229820A

United States Patent [19]

McDougal et al.

[11] Patent Number: 5,229,820

[45] Date of Patent: Jul. 20, 1993

[54] TONER MONITOR MOUNT FOR IMAGE-FORMING APPARATUS

[75] Inventors: David R. McDougal, Fairport; James G. Rydelek, Rochester, both of N.Y.

[73] Assignee: Eastman Kodak Company, Rochester, N.Y.

[21] Appl. No.: 854,929

[22] Filed: Mar. 20, 1992

[51] Int. Cl.[5] ..... G03G 15/01

[52] U.S. Cl. ..... 355/245; 355/208; 355/326

[58] Field of Search ..... 355/326, 327, 246, 207, 355/208, 209, 245, 328, 203; 118/688, 689, 691

[56] References Cited

U.S. PATENT DOCUMENTS

| | | | |
|---|---|---|---|
| 4,620,783 | 11/1986 | Tanaka et al. | 355/326 X |
| 4,849,795 | 7/1989 | Spehrley, Jr. et al. | 355/317 |
| 4,891,672 | 1/1990 | Takagi | 355/245 |
| 4,894,684 | 1/1990 | Nakajima et al. | 355/207 |
| 4,937,626 | 6/1990 | Kohtani et al. | 355/245 |
| 5,083,161 | 1/1992 | Borton et al. | 355/208 |
| 5,105,217 | 4/1992 | Igawa | 355/202 |

FOREIGN PATENT DOCUMENTS

| | | | |
|---|---|---|---|
| 0381518 | 8/1990 | European Pat. Off. | 355/327 |
| 0253769 | 10/1989 | Japan | 355/327 |
| 0064570 | 3/1990 | Japan | 355/326 |

OTHER PUBLICATIONS

U.S. Ser. No. 07/621,686, filed Dec. 3, 1990, De Cecca et al.

U.S. Ser. No. 07/632,677, filed Dec. 24, 1990, Kroll et al.

U.S. Ser. No. 07/669,701, filed Mar. 15, 1991, Kroll et al.

U.S. Ser. No. 07/770,266, filed Oct. 3, 1991, Miller et al.

U.S. Ser. No. 07/794,761, filed Nov. 19, 1991, De Cecca et al.

*Primary Examiner*—A. T. Grimley
*Assistant Examiner*—T. A. Dang
*Attorney, Agent, or Firm*—Leonard W. Treash

[57] ABSTRACT

A toner monitor mount holds a toner monitor for engagement by each of a plurality of toner stations. To assure intimate contact between a monitor and an engaging wall of each of the stations, the mount includes a spring which urges the monitor against the engaging wall. The mount permits rotational movement of the monitor about an axis parallel to movement of the stations and an axis across the movement of the stations to assure repeating intimate contact of the monitor with the engaging wall of the stations.

12 Claims, 5 Drawing Sheets

TONER MONITOR MOUNT FOR IMAGE-FORMING APPARATUS

TECHNICAL FIELD

This invention relates to the development of electrostatic images. More specifically, it relates to a mount for a toner monitor, which toner monitor senses the concentration of toner in more than one toning station.

BACKGROUND ART

U.S. Pat. No. 4,620,783 discloses an image-forming apparatus having a plurality of development units indexable into alignment with a development position associated with a photoconductive drum. A single bulk toner detector is provided for sensing the amount of toner in a toner supply of whichever development unit is aligned with the drum.

U.S. patent applications Ser. No. 632,677, filed Dec. 24, 1990 to Kroll et al and Ser. No. 770,266, filed Oct. 3, 1991 to Miller et al show a series of development units which move through a linear path, which path brings each station successively into alignment with a development position. A single toner monitor is positioned along the path to monitor developer in each station when positioned adjacent the monitor.

U.S. Pat. No. 5,111,245, issued May 5, 1992 to DeCecca et al and U.S. patent application Ser. No. 669,701, filed Mar. 15, 1991 to Kroll et al also show a linearly moving set of toning units in which each unit is moved into alignment with a development position and then only the applicator of each unit as it is aligned is moved into the toning position or toward the toning position from a position slightly spaced from the position.

U.S. patent application Ser. No. 794,761, filed Nov. 19, 1991 to DeCecca et al (a continuation of U.S. patent Ser. No. 632,706, filed Dec. 24, 1990) shows a rack and pinion mechanism for translating a series of development stations through a position aligned with a development position.

Present state of the art toner monitors have their greatest sensitivity and greatest accuracy if they are placed as close to the mixture being monitored as possible. For this reason, monitors are commonly placed in a strategic location inside a sump of a toning station. In situations in which a monitor is not part of the station itself, it is placed closely adjacent a wall of the station and the wall may be thinned at that location to improve sensitivity.

If a single monitor is to be used to sense toner concentration of more than one movable station with consistency and sensitivity, that monitor must be positioned repeatedly in close proximity to the mixture being sensed.

DISCLOSURE OF THE INVENTION

It is an object of the invention to provide a mount for a toner monitor for an image-forming apparatus which apparatus has a plurality of development stations, which stations are movable along a path, in which the toner monitor successively intimately engages an engagement wall of each of the developer stations or units as said stations move along the path.

These and other objects are accomplished by a mount for the toner monitor, which mount positions the toner monitor with respect to a Z axis parallel to the direction of movement of the stations, an X axis perpendicular to the engagement wall of the toner station being monitored and a Y axis perpendicular to the X and Z axes and generally across the direction of movement of the stations. The mount includes means for urging the mount in the X direction to hold a monitor surface of the monitor against the engagement wall of the station being monitored and for permitting limited rotational movement around the Y and Z axes to permit the monitor surface to intimately engage the engagement wall.

This mount assures close engagement of the monitor surface with the engagement wall of the development station despite the fact that the station repeatedly slides into position with respect to the monitor surface.

According to a preferred embodiment, the mount includes first and second plates having first and second plate surfaces, respectively, generally facing each other and a generally flat mounting member positioned between the first and second plate surfaces. The monitor is fixed to the first plate. The second plate is fixed to the base of the apparatus. The mounting member has first and second faces which face the first and second plate surfaces, respectively. The first face and the first plate surface include complimentary, spherically-shaped portions which engage each other and permit movement of the first plate around the Y and Z axes to permit freedom of movement of the monitor around those axes. The second plate surface and the second face are urged apart by a light spring which in operation urges the monitor surface against the engagement wall of the station.

Preferably, the spherical surfaces have a common center on the monitor surface. Rotation of the first plate with respect to the second plate is around an axis on the monitor surface and does not result in movement of the monitor parallel to the y and z axes.

BEST MODE OF CARRYING OUT THE INVENTION

Figure 1:
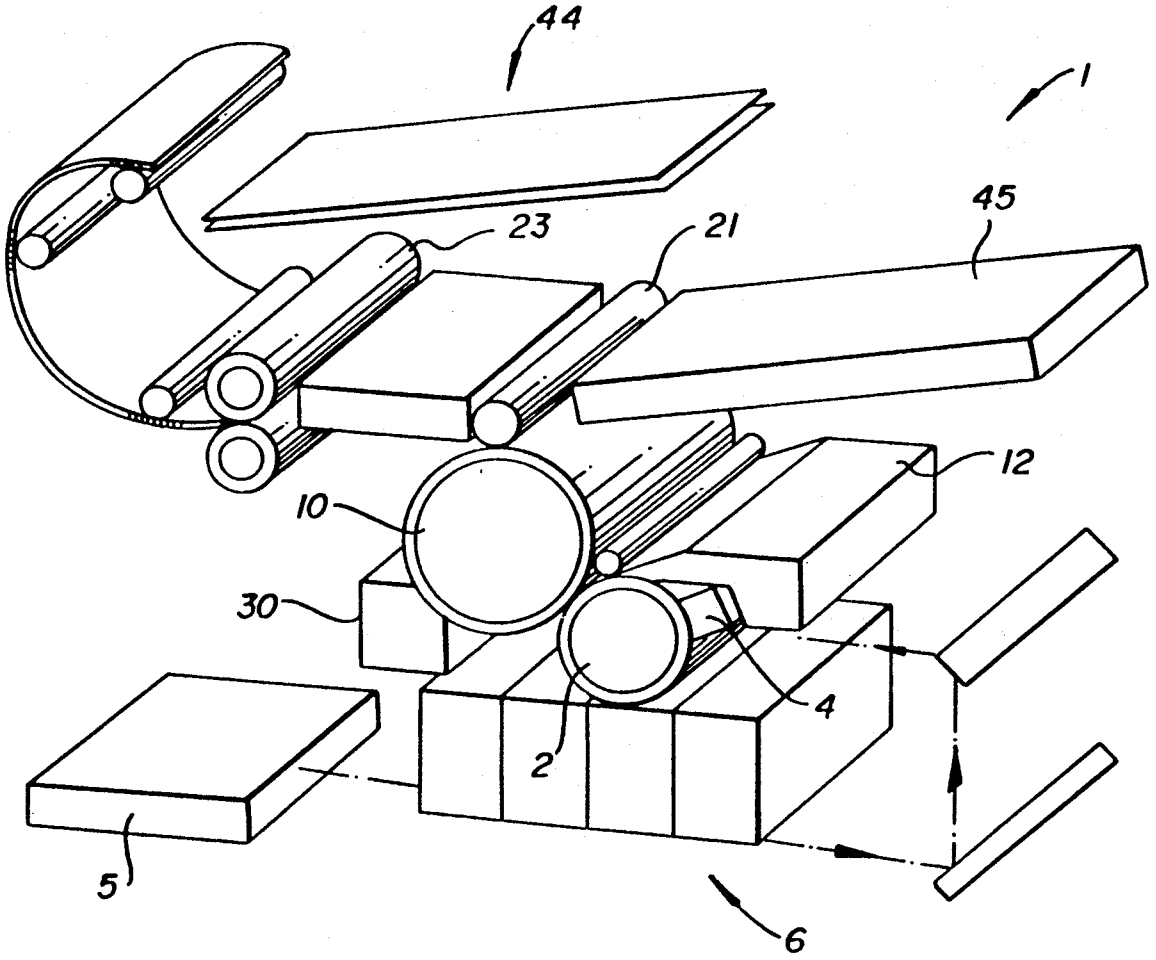
FIG. 1 is a perspective schematic of an image-forming apparatus illustrating the relationship of various stations and parts without any housing.

According to FIG. 1, an image-forming apparatus 1 includes an image member 2 having a periphery on which a series of different color images are formed. More specifically, the periphery of image member 2 is photoconductive and is uniformly charged by a charger 4 and exposed by a laser 5 to create a series of electrostatic images thereon. Each of the electrostatic images is toned by a different one of a set of toning stations included in a development device 6 to create a series of different color toner images on the periphery of image member 2. Image member 2 can be a photoconductive drum as shown or an endless web or other similar-type image member on which electrostatic images can be formed.

The series of different color toner images are transferred, in registration, to the periphery of a transfer drum 10 to create a multicolor image. The multicolor image is transferred to a receiving sheet fed from a receiving sheet supply 45 to a transfer station 21. The receiving sheet is fed to a fuser 23 for fixing of the multicolor image to the receiving sheet and, ultimately, the receiving sheet is fed to an output tray 44. The image member 2 is continuously cleaned by a cleaning device 12 and the transfer drum 10 is intermittently cleaned by a cleaning device 30 which is articulatable with respect to transfer drum 10.

Figure 2:
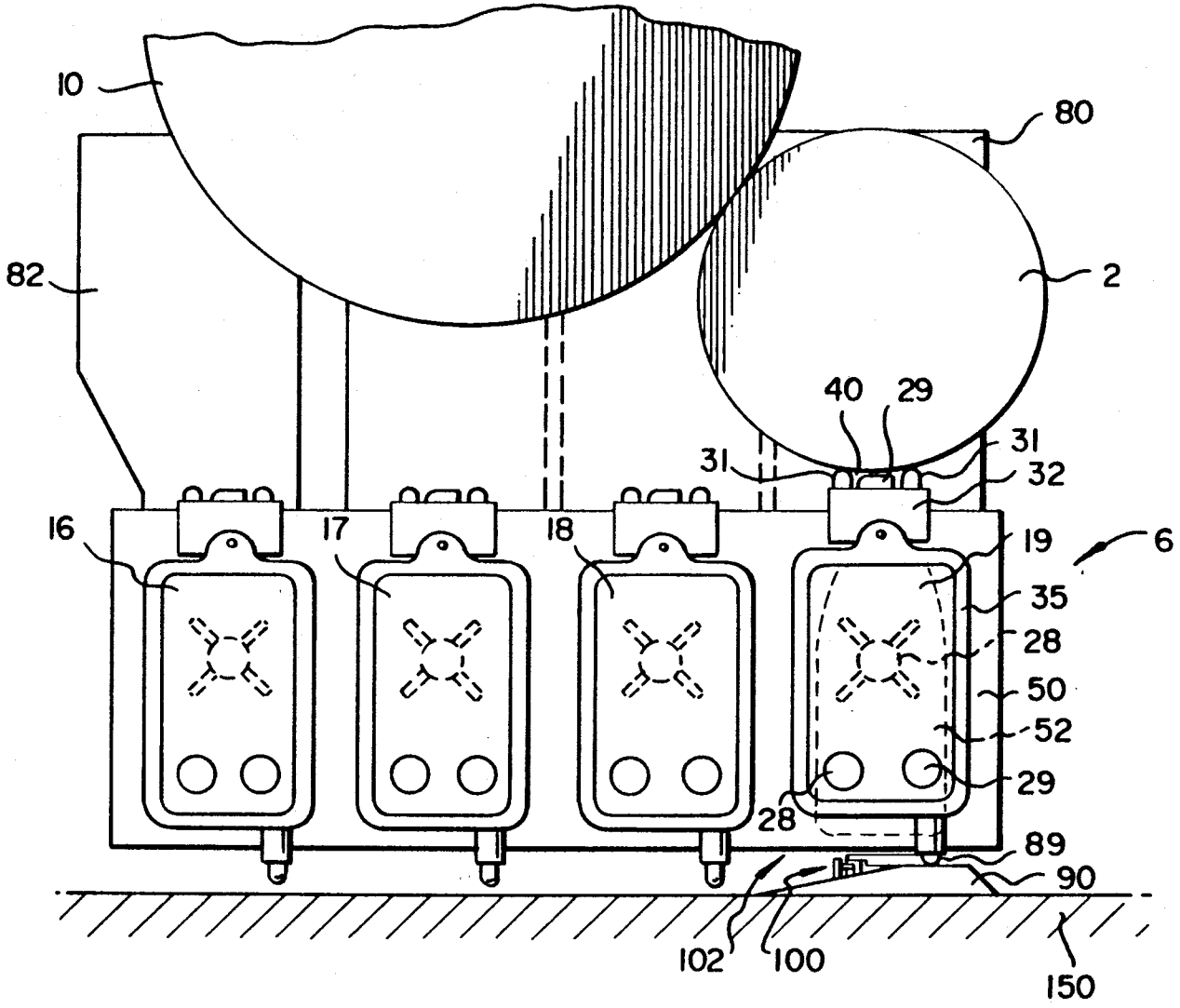
FIG. 2 is a side view of a development portion of an image-forming apparatus.

According to FIG. 2, development device 6 includes four toning stations or units 16, 17, 18 and 19. The toning stations can be formed in a single housing 50 as shown in FIG. 2 or they can be separate stations carried in a single support. The stations are mounted for generally linear movement to index the stations through a position aligning them with a development position 40 associated with image member 2. As shown in FIG. 2, station 19 is aligned with development position 40. As part of becoming aligned or after the station has become aligned with the development position 40, an applicator 29 is moved toward or into development position 40 to develop an electrostatic image on image member 2. As shown in FIG. 2, a pair of rollers 31 are located at each end of applicator 29 and engage the periphery of image member 2 to accurately space applicator 29 with respect to that periphery. Applicator 29 is raised into the development position 40 by the interaction of a pin 89 at the bottom of station 19 and a ramp 90 strategically positioned with respect to development position 40. Pin 89 is pushed in a generally upward direction by ramp 90 to push a connecting yolk 35 also in a generally upward direction. Yolk 35 is connected through a block 32 to applicator 29. Applicator 29 is moved upward into position in response to the upward movement of yolk 35.

Each toning station includes a toner sump 52 (shown in phantom in FIG. 2) in which is located a paddle 28 which propels developer up to applicator 29. A pair of augers or paddle wheels 28 and 29 toward the bottom of sump 52 thoroughly mix a mixture of toner and carrier in the sump.

A single toner monitor 100 is positioned below development device 6 resting generally on a base 150 which can be a floor defined by the housing of the image-forming apparatus. The toner monitor 100 is positioned to engage an engagement wall 102 of each development station as that development station becomes aligned with development position 40. Although the toner monitor 100 could be positioned to engage each station at a position remote from alignment with development position 40, it is preferable to monitor the station, in fact, doing the developing for best results when a large run of single-color images is being formed.

Figure 3:
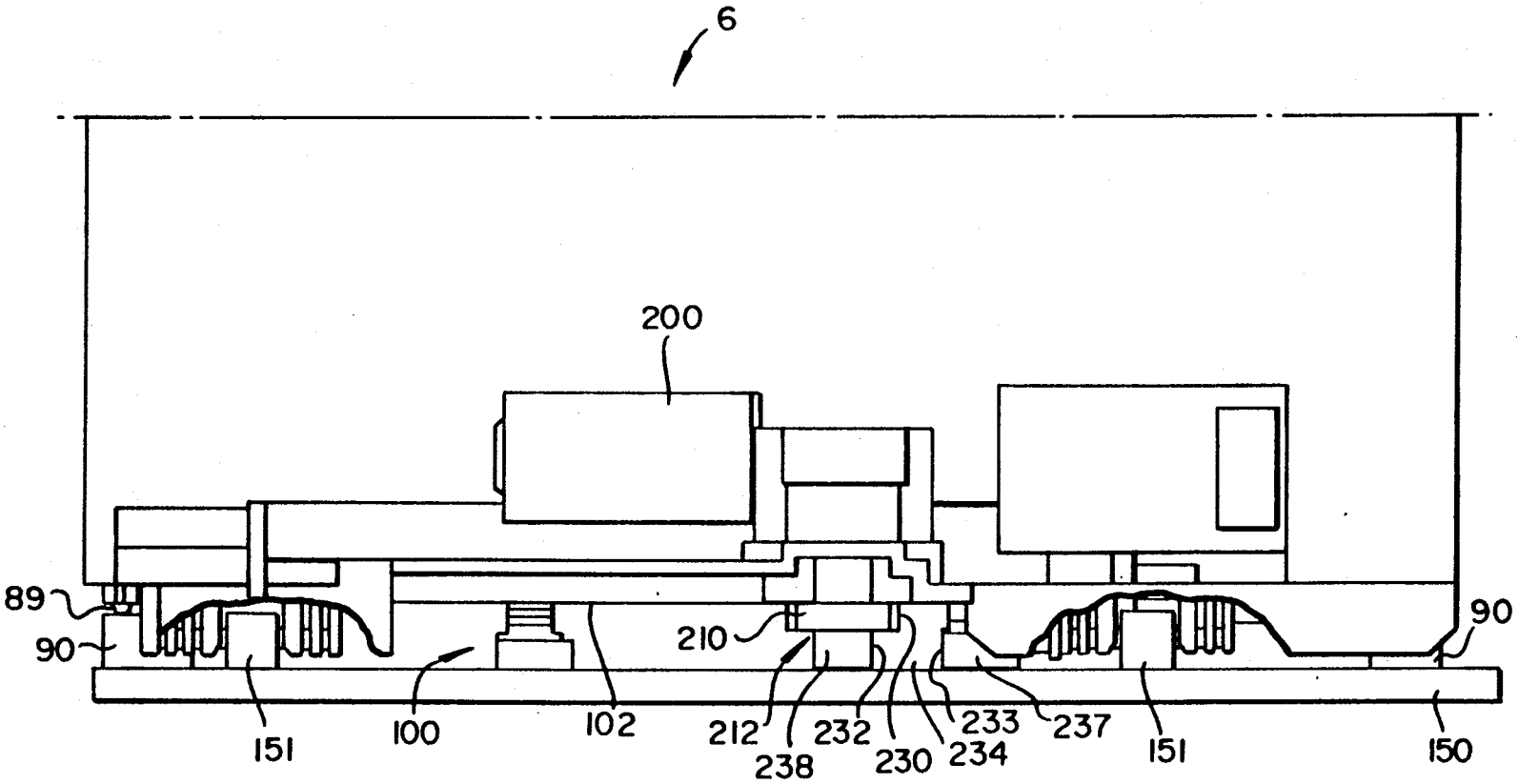
FIG. 3 is a front view of the lower portion of the development apparatus.

Referring to FIG. 3, details of the transport mechanism for development device 6 are shown with some portions cut away for clarity. As shown in FIG. 3, development device 6 is supported by four rollers 151 which ride on base 150. A rack member 234 includes a rack 230 and bearing surfaces of rails 232 and 233. A pinion 210 is concentrically mounted with a wheel 238 on a pinion member 212. The pinion member 212 is driven by a motor 200 through a right-angle drive. A spring-urged wheel or roller 237 engages bearing surface 233. Its spring urging maintains pinion 210 in rack 230 and roller or wheel 238 against bearing surface 233. A third roller, not shown, is behind roller 238 and also engages bearing surface 232. Motor 200 rotates pinion 210 to drive development device 6 along rack member 234. Starting and stopping of motor 200 can be accomplished in response to sensors strategically placed in the path of development device 6.

Absolute positioning of the bottom of each of the toning stations as it moves through its indexing path is not possible. However, the location of a toner monitor with respect to a developer mixture in each developer sump is critical to the sensitivity of the monitor.

This accurate positioning of the toner monitor is accomplished by a toner monitor mount 100 which will be described in more detail with respect to FIGS. 4, 5 and 6.

Figure 4:
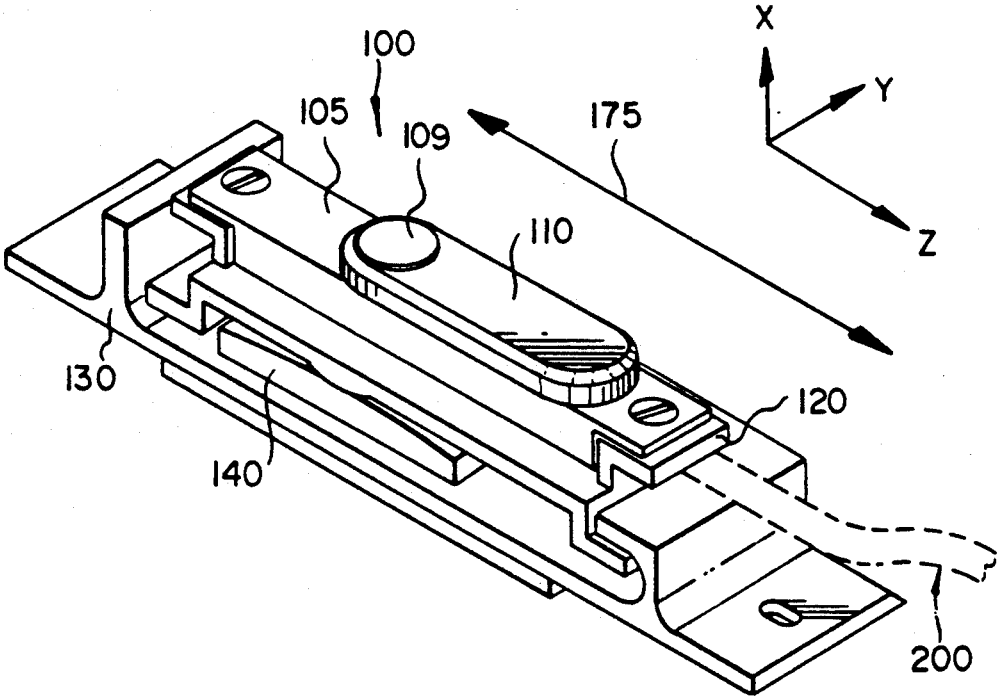
FIGS. 4, 5 and 6 are perspective, top and side views of a toner monitor mount.
Figure 5:
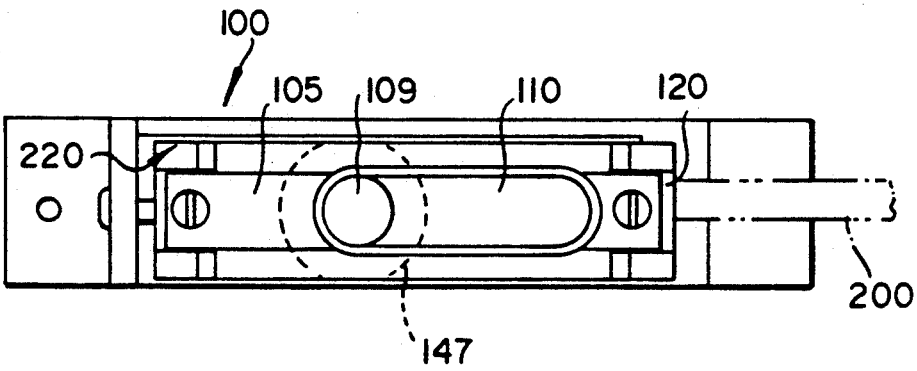
Figure 6:
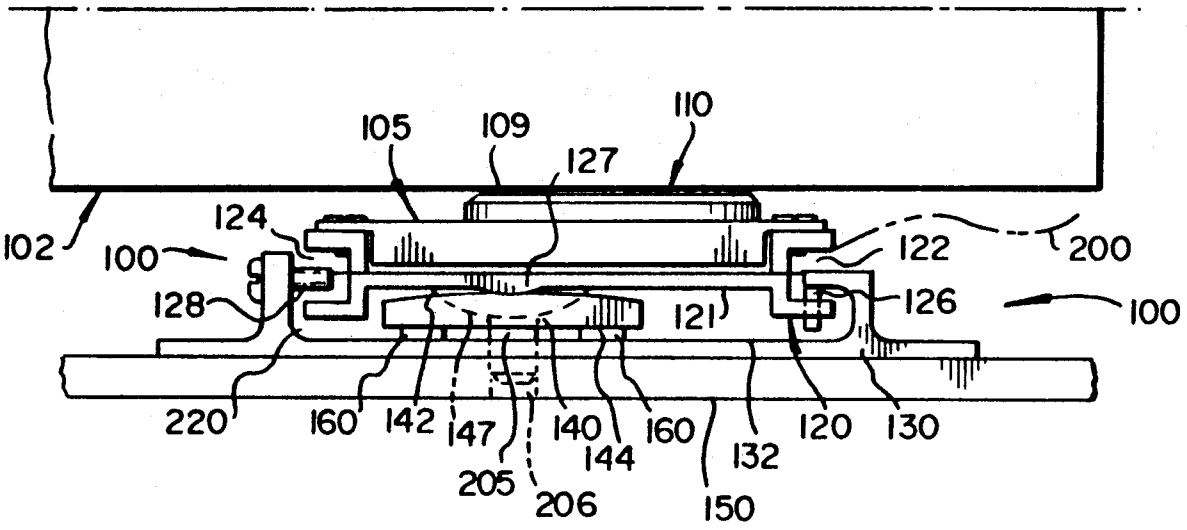

According to FIGS. 4 through 6, toner monitor mount 100 includes a toner monitor 105 having a button-shaped portion 107 positioned in a guide 110. The button portion 107 has a flat upper monitor surface 109 that is slightly above the upper surface of guide 110.

Monitor 105 is fixed by screws to a first plate or cradle 120. Cradle 120 defines slots 122 and 124 positioned generally below the screws and best seen in FIG. 6.

A second plate or baseplate 130 is positioned generally below cradle 120 and may be integrally formed with base 150. A rectangular pin 126 extending downward from a tab in second plate 130 fits into a slot in cradle 120.

A screw or pin 128 provides retention at the other end of cradle 120. A mounting member or pivot member 140 is positioned between the first and second plates 120 and 130. The pivot has a first upper face 142 which faces a first plate surface 121 on the bottom of cradle 120. A second face 144 faces a second plate surface 132 on second plate 130. Two light compression springs 160 are positioned between the second face and the second plate surface. The first face 142 of mounting member 140 has a concave spherical surface 147 which receives a convex spherical surface 127 which protrudes from the first plate surface 121. A post 205 of mounting member 140 slides in a vertical hole 206 through second plate surface 132 of plate 130.

Operation is best explained with respect to x, y and z axes shown in FIG. 4. The z axis is parallel to the direction of travel of development device 6 shown by arrow 175 in FIG. 4. The x axis is perpendicular to an engagement surface 102 (FIG. 6) of the development station being monitored. The y axis is perpendicular to the x and z axes and is generally across the direction of travel of the development device 6.

The center of spherical surface 127 and 147 is essentially a point at the center of surface 109 of toner monitor 105. As the surface 109 conforms to the surface 102, the monitor is allowed to rotate a very small amount about the y and z axes between surfaces 127 and 147. Because the center of surfaces 127 and 147 is a common point on the center of surface 109, surface 109 does not move in a direction parallel to the y and z axis and stays in essentially the same location, despite any rotational movement between surfaces 127 and 147. Springs 160 lightly push members 140, 120 and 105 along the x axis of post 205, thus keeping surface 109 in contact with surface 102. The previously mentioned spherical relation of surfaces 127 and 147 provide the location and conformity of surface 109 to 102.

Pin 126 is positioned in a slot in the cradle 120 and generally controls the linear position of the monitor 105 with respect to the z axis. Wall 220 limits rotation of the monitor 105 about the x axis.

This mount thus provides a limited amount of movement of surfaces 109 and 110 parallel to the x axis and about the y and z axes without injecting movement parallel to the y and z axes. This movement permits the surface 109 to conform to variations in the engagement wall 102 of the development station being monitored without changing the monitor location.

The first and second plates and the mounting members 120, 130 and 140, respectively, can all be made of plastic. Preferably, the second plate 130 is molded into the base 150 and, therefore, does not have to be separately assembled.

Figure 7:
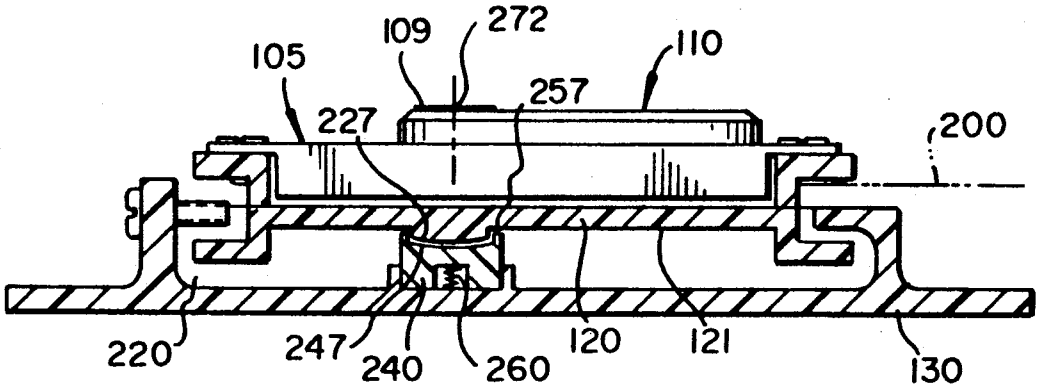
FIG. 7 is a side view with portions in section of an alternative embodiment of a toner monitor mount.

FIG. 7 illustrates a second embodiment of the toner monitor mount. Mounting member 140 has been replaced by a different shaped mounting member 240 which fits in a cylindrical cavity in the base 130. It includes a central hole for a single compression spring 260 urging member 240 away from base 130. A spherical top surface 247 is surrounded by a lip 257 and mates with a spherical surface 227 constructed substantially as in the embodiment shown in FIGS. 4–6 in the first plate surface 121. The spherical surfaces 227 and 247 have a common center of curvature at point 272 on the surface 109.

There is sufficient play between lip 257 and the edges of surface 227 with respect to surface 247 to allow rotation of surface 109 about point 272 around both the y and z axes. At the same time, lip 257 prevents surface 227 from slipping laterally away from surface 247. Spring 260 urges member 240 parallel to the x axis as in the other embodiment. Note that the pin 126 in FIG. 6 has been eliminated in this embodiment.

The invention has been described in detail with particular reference to a preferred embodiment thereof, but it will be understood that variations and modifications can be effected within the spirit and scope of the invention as described hereinabove and as defined in the appended claims.

We claim:

1. Image-forming apparatus comprising:

a plurality of developer stations movable in a direction along a path, a toner monitor positioned along said path and having a monitor surface engageable with an engagement wall of said stations as said stations move along said path, the engagement wall of each station being oriented generally parallel to the direction of movement, at least when engaged by the monitor surface, a mount for said toner monitor, said mount positioning said monitor surface with respect to a z axis parallel to the direction of movement, an x axis perpendicular to the engagement wall of a toner station being monitored, and a y axis perpendicular to the x axis and the z axis, said mount including means for urging said monitor parallel to the x axis to hold it against the engagement wall and for permitting limited rotational movement around both the y axis and the z axis to accommodate the engagement wall.

2. Image-forming apparatus according to claim 1 further including means for limiting movement of said monitor parallel to the x axis toward an engagement wall.

3. Image-forming apparatus according to claim 1 wherein said mount includes a first plate fixed to or integral with said monitor, said first plate defining a first plate surface, and a second plate attached to or integral with a base or wall of said image-forming apparatus, said second plate defining a second plate surface, said first plate surface facing said second plate surface, said means for urging said mount parallel to the x axis and for permitting limited rotational movement around the y and z axes at least in part being positioned between said first plate surface and said second plate surface.

4. Image-forming apparatus according to claim 3 wherein said first plate surface has a convex spherical surface having a center of curvature on said monitor surface, and said means for urging includes a mounting member having a concave spherical surface of substantially the same curvature as the convex surface, said convex spherical surface and said concave spherical surface being engageable in response to said urging and slidable with respect to each other to permit said rotational movement around said y and z axes.

5. Image-forming apparatus according to claim 4, wherein said mounting member has a first face and a second face opposite to said first face and a spring positioned between said second face and said second plate surface, urging said mounting member toward said first plate surface.

6. Image-forming apparatus according to claim 4 further including means for preventing movement of said first plate in a direction parallel to the z axis which means combined with said spherically shaped portions also prevents movement of said first plate with respect to said second plate around the x axis and parallel to the y axis.

7. Image-forming apparatus according to claim 5 further including means for limiting movement of said first plate under urging of said spring parallel to the x axis.

8. A toner monitor mount for use in an image-forming apparatus having a toner monitor, a wall or base, a toning station having an engagement surface, which station is movable in a direction with respect to said wall or base, said toner monitor mount positioning said monitor with respect to a z axis parallel to the direction of movement of the station, an x axis perpendicular to the engagement surface and a y axis perpendicular to the x axis and the z axis, said toner monitor mount comprising:

a cradle to which said monitor is fixed, a baseplate fixed to or integral with said wall or base, means positioned between said cradle and said baseplate for urging said cradle toward said engagement surface and for permitting rotational movement of said cradle around both said y axis and said z axis with respect to said baseplate.

9. For use in an image-forming apparatus having an image member, a machine base, a toner monitor and at least two toning stations, the toning stations being positionable, one at a time, between the toner monitor and the image member, each of the toning stations having a surface against which the toner monitor is positioned when the toning station is positioned between the image member and the toner monitor, a device for supporting the toner monitor flush with the surface of each toning station, said device comprising:

a cradle to which said toner monitor is fixed with said toner monitor facing toward said toning station surface, said cradle having a first pivot surface facing away from said toning station surface, a pivot member which includes a second pivot surface facing and adapted to engage said first pivot surface of said cradle and shaped to permit rotation of said cradle with respect to said pivot member, and means for urging said pivot member toward said cradle to engage said pivot surface.

10. The device of claim 9 wherein said urging means includes at least one compression spring located between said pivot member and the machine base.

11. The device according to claim 9 wherein the first pivot surface and the second pivot surface are complimentary spherical surfaces.

12. The device according to claim 11 wherein the complimentary spherical surfaces when engaged have a common center of curvature on a surface of the toner monitor engageable with the toning stations.

* * * * *